United States Patent [19]

Brown

[11] Patent Number: 4,748,872

[45] Date of Patent: Jun. 7, 1988

[54] FLEXIBLE POWER TOOLS

[76] Inventor: William J. Brown, 11350 Inverness Dr., St. Ann, Mo. 63074

[21] Appl. No.: 856,805

[22] Filed: Apr. 28, 1986

[51] Int. Cl.[4] ..... B25B 17/00

[52] U.S. Cl. ..... 81/57.26; 81/57.27; 81/57.43

[58] Field of Search ..... 81/57.26, 57.27, 57.28, 81/57.43, 177.7, 177.75, 177.8, 177.9, 177.85; 464/161, 162, 109

[56] References Cited

U.S. PATENT DOCUMENTS

| | | | |
|---|---|---|---|
| 1,975,695 | 10/1934 | Lund | 81/177.75 |
| 2,073,903 | 3/1937 | O'neil | 81/436 |
| 2,268,802 | 1/1942 | Coffman | 81/57.27 |
| 2,498,465 | 2/1950 | Thomas | 81/177.7 |
| 2,499,569 | 3/1950 | Cooley | 81/177.75 |
| 2,501,217 | 3/1950 | Hawn | 81/57.27 |
| 4,075,913 | 2/1978 | Tye | 81/177.75 |
| 4,530,261 | 7/1985 | Ventura | 81/177.75 |
| 4,552,544 | 11/1985 | Beckman | 464/162 |

*Primary Examiner*—Robert P. Olszewski
*Assistant Examiner*—Bradley I. Vaught
*Attorney, Agent, or Firm*—Joseph A. Fenlon

[57] ABSTRACT

This invention presents a flexible power tool in which a flexible drive is utilized to permit the power supplying end to be angularly displaced from the work performing and during powered drive without inherent wobble, which is achieved first by pivotally connecting the power supplying end to the work performing end through a spring biasing device which resists the angular movement of the two ends during powered drive and second by utilizing a unique differential drive shaft in which the two pivoting differential axes are intersecting and coplanar, and the shaft is mounted in the tool in such manner that the coplanar axes can float into alignment with the pivotal axis between the ends of the tool.

8 Claims, 2 Drawing Sheets

FIG. 1
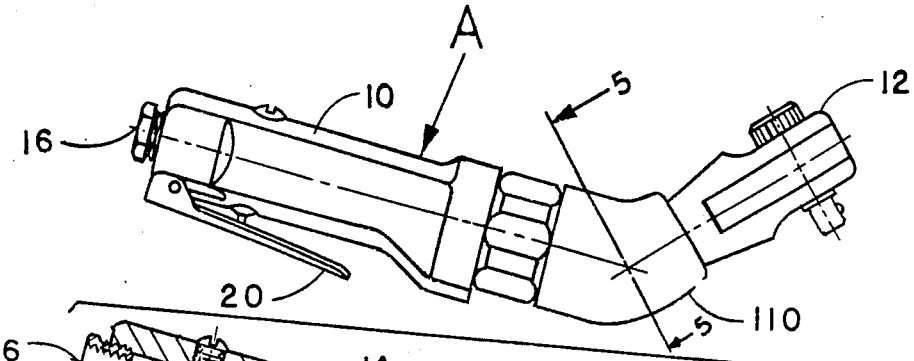
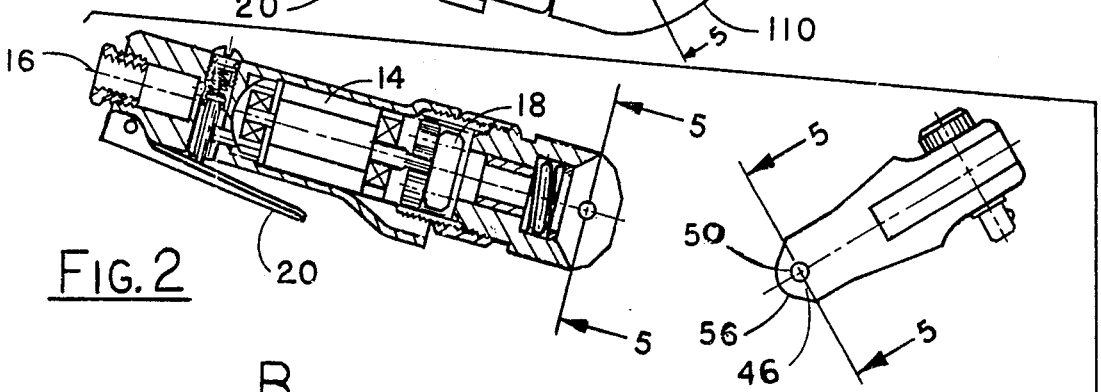
FIG. 2
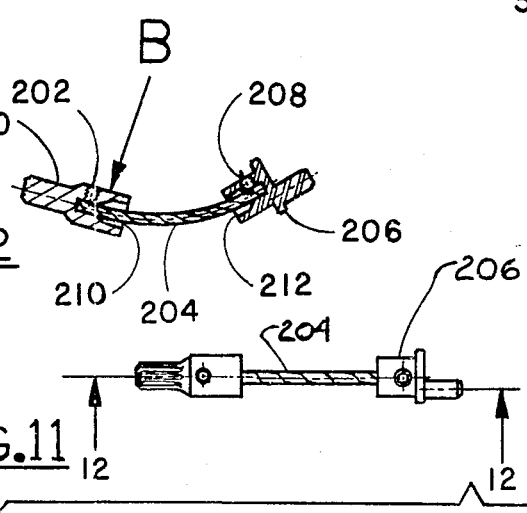
FIG. 12
FIG. 11
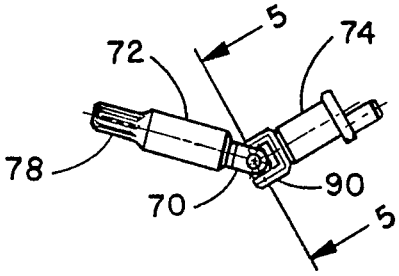
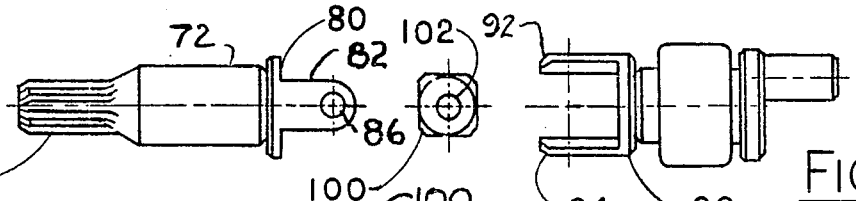
FIG. 4
FIG. 3
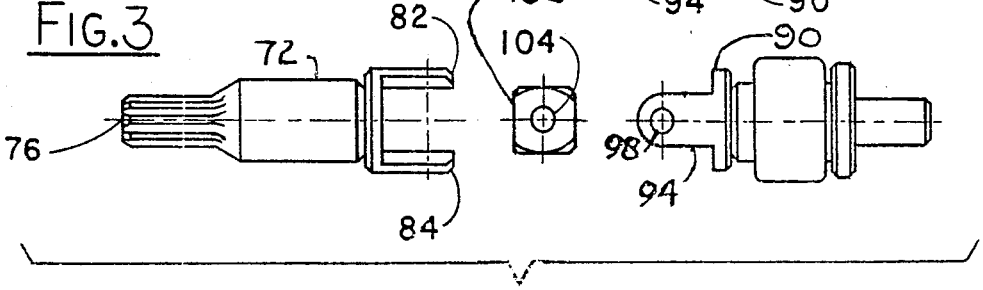

FLEXIBLE POWER TOOLS

This invention relates to power tools.

It is the object of this invention to provide a power tool which is sturdy yet flexible and is suitable for providing powered drive around corners and to generally inaccessible areas.

One of the primary difficulties presently encountered with power tools such as power ratchets is that the tool itself is generally straight, rigid and bulky and that a lot of the areas where powered tools are required is generally inaccessible. A need has existed for some time for a powered tool which is flexible and which can be used in generally inaccessible areas. The tools which have attempted to be developed are excessively bulky and have inherent wobble in their operation. Other attempts have been made which incorporate flexible cables, but these are deemed unsatisfactory. This invention provides a tool which is flexible, which can provide controlled, powered drive in inaccessible areas, and which is free of wobble.

IN THE DRAWINGS

FIG. 1 is a side elevational view of a preferred embodiment of my invention.

FIG. 2 is an exploded view of my invention with the covers removed.

FIG. 3 is a front elevational enlarged exploded view of the drive shaft.

FIG. 4 is a bottom view of FIG. 3.

FIG. 11 is a front elevational view of a second embodiment of the drive shaft.

FIG. 12 is a fragmentary sectional view taken along lines 12—12 of FIG. 11.

Figure 5:
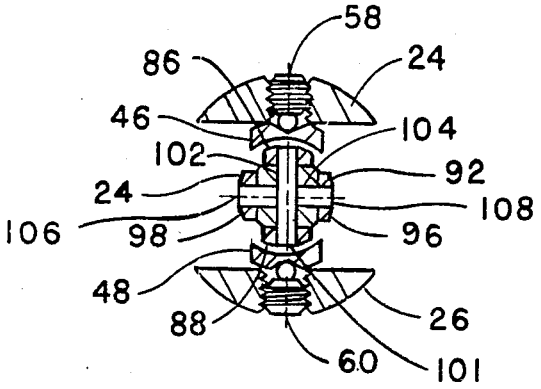
FIG. 5 is an enlarged sectional view taken along lines 5—5 of FIG. 2.
Figure 6:
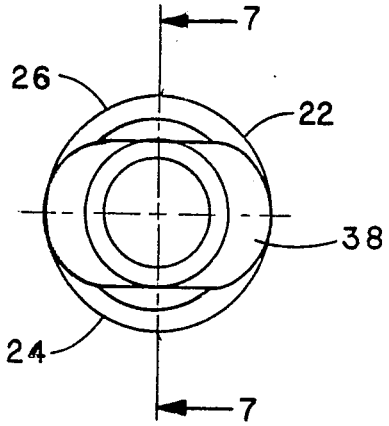
FIG. 6 is an enlarged end view of the handle.
Figure 8:
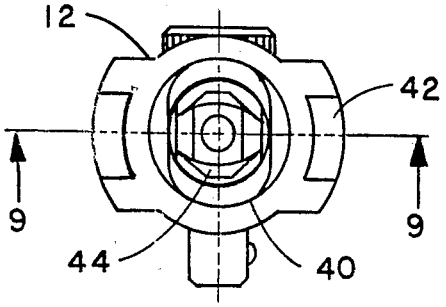
FIG. 8 is an end view of the ratchet section.
Figure 7:
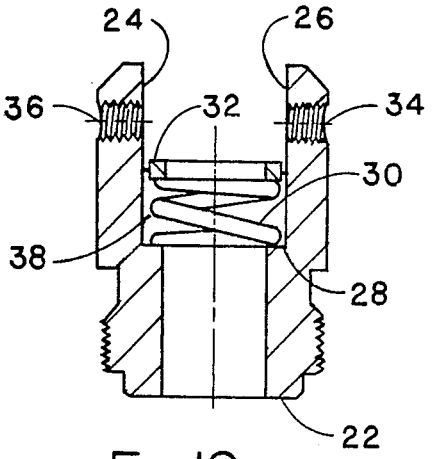
FIG. 7 is a fragmentary sectional view taken along lines 7—7 of FIG. 6.
Figure 9:
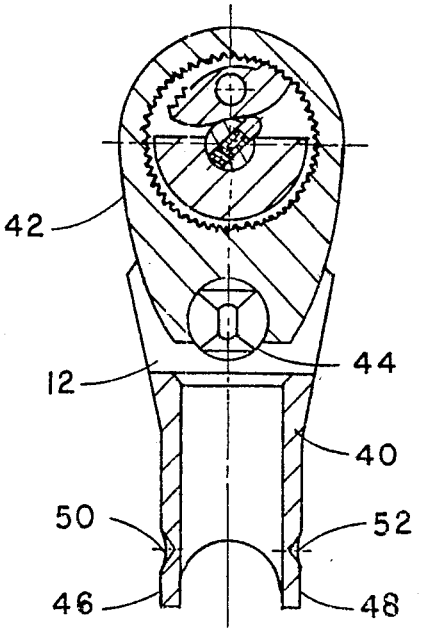
FIG. 9 is a sectional view along lines 9—9 of FIG. 8.
Figure 10:
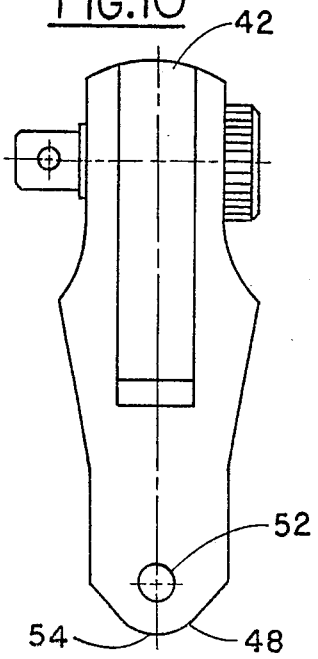
FIG. 10 is a side view of FIG. 9.

Referring now in more detail and by reference character to the drawings which illustrate a preferred embodiment of my invention, A designates a flexible ratchet pneumatic tool comprising a handle section 10 and a ratchet section 12 which is pivotally attached thereto.

The handle section 10 includes a motor 14 conventionally attached to an external pneumatic power source (not shown) through an inlet 16 and conventionally adapted to provide powered drive to a rotor 18 upon manipulation of a trigger 20.

Threadedly connected to the powered end of the handle 10 is a tubular housing 22 including a pair of spaced ears 24, 26 and a recessed annular shoulder 28 on which is disposed a spring 30 and an upwardly presented washer 32. The spaced ears 24, 26 each include a threaded bore 34, 36 which share a common axis, and the internal wall 38 of the housing 22 intermediate the shoulder 28 and the ears 24, 26 is flared outwardly, all for purposes presently more fully to appear.

The ratchet section 12 includes a housing 40, provided at its outer end with a conventional ratchet 42 conventionally adapted for rotating a ratchet in a preselected direction upon receipt of powered rotational drive at a power receiver 44. At the end closest the handle 10, the ratchet section 12 is provided with a pair of spaced complementary ears 46, 48, sized to be nestedly disposed in the housing 22 between the ears 24, 26. Each ear 46, 48, is respectively provided with recesses 50, 52, and is respectively provided with a radial outer periphery 54, 56. The ratchet section 12 is pivotally secured to the handle 10 by means of a pair of set screws 58, 60, which are threadedly inserted into the threaded bores 34, 36, respectively, and which included smooth retaining balls 62, 64, respectively, which are snugly disposed in the recesses 50, 52, and in such position the spring 30 presents a biasing force to the radial peripheries 54, 56 of the ears 46, 48 through the washer 32.

Provided for transferring the power from the rotor 18 to the power receiver 44 is a flexible universal drive shaft 70 including a first element 72 and a second element 74. The first element 72 comprises a first elongated shaft 76 provided at one end with a gear spline 78 adapted for movable nested engagement with the rotor 18 and provided at its outer end 80 with a first pair of axially extending spaced ears 82, 84, each of which includes a complementary bore 86, 88, which lie on a common axis which is perpendicular to the longitudinal axis of the shaft 70.

The element 74 is provided at its end 90 presented toward the motor 14 with a second pair of axially extending ears 92, 94, in each of which is provided a complementary bore 96, 98, respectively, the bores 86, 88, being aligned along a common axis which is perpendicular to the longitudinal axis of the element 74. The other end of the second element 74 is provided with a crank 112 including an elongated drive pin 114 sized for continuing nested engagement with the power receiver 44 of the ratchet 42 to transfer rotational power to the ratchet 42 in the conventional manner as the element 74 is rotated.

Nestedly disposed between the first element 72 and the second element 74 is a spider block 100 provided centrally with two intersecting perpendicular bores 102, 104, the first bore 102 being for receiving a pin 101 which extends through the bore 102 and into the bores 86, 88, of the ears 82, 84, and the second bore 104 being for receiving two shorter pins 106, 108, the pin 106 being disposed in the bore 96 and one part of the bore 104, and the pin 106 being disposed in the bore 98 and the other part of the bore 104.

It is noted that when the tool A is fully assembled, the two intersecting bores 102, 104, will define a plane. The various elements described herein are to be sized such that the axis defined by the threaded bores 34, 36, and the intersecting axis of the bores 102, 104, all lie in a common plane. A flexible protective cover 110 is disposed between the handle section 10 and the ratchet section 12.

USE

In use, power is applied from the motor 14 to the ratchet 42 through the drive shaft 70. The force imposed against the ratchet housing 40 by the washer 32 pressing against the outer peripheries 54, 56 of the ears 46, 48, permits the ratchet section 12 to be selectively angularly disposed with respect to the handle section 10. As power is transferred through the shaft 70, the user will note there is no wobble in the tool A nor is there any force noticed which would tend to change the angular position of the ratchet section 12 with respect to the handle section 10. This is due to the relationship of the pivotal axis of the tool A and the common pivotal axis of the universal drive shaft 70 as previously pointed out, coupled with the fact that the spline gear 78 and the crank pin 114 will shift themselves longitudinally during rotation to keep the bores 102, 104 of the spider block 100 in registration with the axis defined by bores 34, 36. Applicant believes that this longitudinal shifting is due to the principle of dynamics which holds that a body in motion tends to follow the path of least resistance, and since wobble is a unnatural balance condition, the drive shaft 70 will be longitudinally positioned during rotation to accept a position which for each particular circumstance is wobble free.

SECOND EMBODIMENT

Referring now to FIGS. 11 and 12, B represents a second preferred embodiment of my power transfer unit which replaces the drive shaft 70 and which comprises a spline 200, a flexible cable 204 and a crank 206. The cable 204 is disposed within a countersunk bore 210 in the spline 200 and is secured therein by means of a set screw 202. Similarly, the other end of the cable 204 is disposed in a countersunk bore 212 in the crank 206 and secured therein by means of a second set screw 208.

In use, the flexible cable 204 flexes the angular relationship of the handle 10 and the ratchet section 12 are varied and is held in that flexed position by the force of the spring 30 which urges the washer 32 against the ears 46, 48. The clearance provided for the cable 204 by the countersunk bores 210, 212, permits a larger radial bend than would be expected in the cable 204 during powered drive. It has been found the flexible cable permits angular positioning between the ratchet section 12 and the handle 10 up to 90°.

It should be understood that changes in the combination, form, arrangement and construction of the parts herein described can be made and substituted for those herein shown without department from the nature and principal of my invention.

Having thus described my invention, what I desire to secure by Letters Patent is recited in the annexed claims.

In the claims I claim:

1. For use with a power tool including a first housing provided with a motor adapted for providing rotational force upon actuation of a control and a second housing which is pivotally connected to the first housing about a positional axis and includes a work performing means adapted for performing work upon receipt of rotational power, a linkage device comprising a first shaft operatively coupled to the motor for movement therewith, a second shaft operatively coupled to the work performing means, and coupling means for coupling the first shaft to the second shaft, said coupling means including a spider block which is pivotally connected to the first shaft in such manner that pivotal movement of the spider block with respect to the first shaft is about a first axis which is perpendicular to the longitudinal axis of the first shaft, said spider block also being pivotally connected to the second shaft in such manner that the pivotal movement of the spider block with respect to the second shaft is about a second axis which is perpendicular to the longitudinal axis of the second shaft, said first and second axes being mutually perpendicular and coplanar, said linkage device also including floating means which allows axial shifting of the linkage means during powered rotation as the angular position of the first housing and the second housing is selectively varied whereby the coplanar first and second axes automatically shift into planar alignment with the positional axis and wobble is eliminated.

2. The device of claim 1 in which the floating means also includes a crank receiving means operatively connected to the work performing means in the second housing and a crank integrally included in the second shaft, said crank being sized for retaining nested engagement with the crank receiving means as the second shaft is moved along the longitudinal axis of the second housing.

3. The device of claim 1 in which the floating means includes a spline gear on the first shaft operatively coupled to the motor and being of sufficient length to retain the operative coupling as the first shaft shifts longitudinally.

4. The device of claim 1 in which the floating means includes a spline gear on the first shaft operatively coupled to the motor and being of sufficient length to retain the operative coupling as the first shaft shifts longitudinally, and said floating means also includes a crank receiving means operatively connected to the work performing means in the second housing and a crank integrally included in the second shaft, said crank being sized for continued nested engagement with the crank receiving means as the second shaft shifts itself along the longitudinal axis of the second housing.

5. A flexible power tool comprising driving means in a first housing for providing power to a rotor upon actuation of a control element, a second housing pivotally connected to the first housing and including a driven means, biasing means for selectively varying the angular relationship between the first housing and the second housing, an operative element coupling the driving means and the driven means, and floating means for axially shifting the operative element automatically during powered operation whereby wobble is eliminated as the angular relationship between the first housing and second housing is selectively varied.

6. The device of claim 5 in which the biasing means also includes means for retaining the angular relationship of the driving means and the driven means in any preselected position during operation.

7. The device of claim 5 wherein the floating means includes an elongated spline gear operatively coupled to the driving means and an elongated crank pin operatively connected to the driven means, said pin and spline gear each being of sufficient length to maintain the power coupling between the driving means and driven means as floating occurs.

8. The device of claim 7 in which the floating means also includes a flexible cable secured to the spline gear and the crank pin and being rotational therewith.

* * * * *